US008616420B2

(12) United States Patent
Schriner

(10) Patent No.: US 8,616,420 B2
(45) Date of Patent: Dec. 31, 2013

(54) BOTTLE CLOSURE WITH BREAKAWAY SKIRT FOR NON-REFILLABLE BOTTLES

(75) Inventor: Gregory Schriner, Peoria, AZ (US)

(73) Assignee: The Dial Corporation, Scottsdale, AZ (US)

( * ) Notice: Subject to any disclaimer, the term of this patent is extended or adjusted under 35 U.S.C. 154(b) by 36 days.

(21) Appl. No.: 13/327,037

(22) Filed: Dec. 15, 2011

(65) Prior Publication Data

US 2013/0153610 A1 Jun. 20, 2013

(51) Int. Cl.
*B65D 47/10* (2006.01)

(52) U.S. Cl.
USPC ..... 222/541.1; 220/255.1

(58) Field of Classification Search
USPC ..... 222/541.1, 541.6–541.8, 147, 153.06; 215/28, 249–253, 256, 263; 220/255.1, 220/257.1, 258.5, 258.3, 265, 266, 268
See application file for complete search history.

(56) References Cited

U.S. PATENT DOCUMENTS

| | | | | |
|---|---|---|---|---|
| 3,931,904 | A * | 1/1976 | Coop | 215/254 |
| 7,228,980 | B2 * | 6/2007 | Morini | 215/253 |
| 2005/0242095 | A1 * | 11/2005 | Serrano et al. | 220/254.3 |
| 2012/0261376 | A2 * | 10/2012 | Padain et al. | 215/43 |

FOREIGN PATENT DOCUMENTS

| | | | |
|---|---|---|---|
| WO | WO 2010/055309 | A1 | 5/2010 |
| WO | WO 2010/055313 | A1 | 5/2010 |
| WO | WO 2010/055314 | A1 | 5/2010 |

* cited by examiner

*Primary Examiner* — Lien Ngo
(74) *Attorney, Agent, or Firm* — David K. Benson

(57) ABSTRACT

A closure for a non-refillable bottle is provided wherein the closure is designed to break apart into at least two portions when an attempt is made to pry the closure from the bottle. The breakage is directed across a frangible demarcation that is configured such that breakage of the closure into pieces does not compromise the seal of the closure on the bottle.

12 Claims, 6 Drawing Sheets

BOTTLE CLOSURE WITH BREAKAWAY SKIRT FOR NON-REFILLABLE BOTTLES

FIELD OF THE INVENTION

The present invention generally relates to bottle closures for use on non-refillable refill bottles, and more particularly relates to a closure having a break-away feature that prevents reinsertion of the refill bottle into the correspondingly configured dispenser.

BACKGROUND OF THE INVENTION

Refill bottles that fit into dispensers as part of a liquid dispensing system are well known in the art. In particular it is desirable to configure the shape of the bottle and/or the closure on the bottle such that the bottle and closure assembly fits into the dispenser housing as a "keyed fit." This is important for at least two reasons. First, there is marketing incentive to have an exclusive shape for a bottle/closure assembly such that a competitor's refill bottle will not fit into the marketed dispenser. Secondly, there is sometimes safety issues when different liquid compositions are dispensed through the same dispensing device and a "lock-and-key" fit between the refill bottle and the dispenser housing helps avoid these issues. For example, a keyed fit ensures the correct refill is placed into the dispenser, and/or a keyed fit may mechanically or electrically trigger a particular dispensing event when the dispenser "recognizes" a particular bottle and/or closure configuration on the refill unit. Such dispensing systems having complementary fit between the shape of the refill bottle/closure assembly and the shape of the dispenser housing are exemplified by the following references: U.S. Pat. No. 5,456,297 (Crossdale, et al.); U.S. Pat. No. 5,682,930 (Crossdale); and U.S. Application Publication No. 2010/0147894 (Reimann, et al.). This art is assigned to Diversey, and was developed for the institutional cleaning market. An example of a keyed fit between refill and dispenser in a dispensing system for hand washing and hygiene is disclosed in U.S. Patent Application Publication No. 2011/010129 (Lewis, et al., assigned to the Dial Corporation) and in U.S. Pat. No. 8,020,733 (Snodgrass, assigned to UltraClenz, LLC).

Another problem with marketing dispensing systems comprising refill bottles and dispensers is that the end user is often tempted to refill the bottle with their own liquids, such as their own soaps and detergents. This is prevalent in the institutional cleaning market where end users find novel ways to cut access holes into the bottom of inverted refill bottles, or they unscrew or otherwise pry off the closure from a refill bottle in order to refill the bottle with the liquid of their choosing. This practice by the end user circumvents the supplier's livelihood since the supplier's profits usually come from the selling of the refill bottles and not the dispensing equipment. Indeed, at least in the institutional cleaning market where the dispensing equipment is often large, complicated and expensive, the dispenser is often loaned to the customer with the expectation that the customer in possession of the dispensing equipment will purchase refill bottles only from the supplier loaning the equipment.

Because of the likelihood of tampering by the end user, and also as a way to mitigate chemical exposure, suppliers have used "tamper-proof" configurations for closures on refill bottles. In the dispensing system context, the ideal non-refillable refill unit may comprise a bottle for liquids having a closure that simply cannot be removed from the neck of the bottle. Indeed, in many dispensing systems where the refill bottle is inverted into the dispenser housing, there isn't a need to remove the closure unless trying to override the supplier's system and refill the bottle. Inverting a typical refill bottle in a dispenser usually triggers a conduit element, such as a spigot, to penetrate a membrane or slit valve, or open a dispensing valve provided in the closure, without the need to remove the closure from the neck of the bottle. Such non-removable closure configurations have been known for many years and include the familiar "ratchet" structure on the neck of a bottle that engage with teeth configured on the inside circumference of the closure skirt, (also referred to as "anti-rotation" lock). These one way ratchet systems prevent removal of the closure from the bottle and hence deter refilling of the bottle with a substitute composition. Presumably the closure and/or the bottle neck would be completely destroyed if the end user succeeds in prying the closure off against the direction of the ratcheting teeth. These types of refill bottles are intended to be inverted in the dispenser, used until empty, then thrown away and replaced with a new, full refill bottle.

An example of a non-refillable dispensing bottle not developed for use in dispensing systems is disclosed in U.S. Pat. No. 4,747,498 (Gach). A dispensing bottle, such as the one disclosed by Gach in '498 may be as simple as a bottle fitted with a non-removable closure that has a dispensing orifice in the closure top. The container neck terminates in an annular end wall having a plurality of circumferentially spaced teeth that lock the cap to the container, preventing refilling.

Another way to prevent the refilling and reuse of a refill bottle designed to fit into a particular dispenser is to make the closure on the bottle break or distort if pried from the bottle opening. The theory is that if the closure is distorted or even broken in some way, it won't fit back on the bottle neck opening and thus the refilled bottle cannot be used in the dispenser, particularly if the bottle has to be inverted for use in the dispenser and is dependent on an intact seal between the bottle neck and the closure. Some examples of non-replaceable closures appear in the patent literature. For example, U.S. Pat. No. 5,284,265 (Crisci) discloses a non-replaceable snap cap for school milk bottles, (outside of the context of dispensing systems). Once a tear skirt is peeled away, a sealing flange is also removed preventing replacement of the cap on the milk bottle. Additionally, a "self-destructing" closure for use on an inverted refill bottle is disclosed in PCT Application Publication No. WO 2010/055313 (Padain, et al.). As best seen in FIG. 8 of the '313 application, frangible members 29 are designed to break if the cap is pried off from the bottle neck. When these members 29 break, the collar configured to snap over the bottle neck falls apart, and there is no way to fit the closure back onto the bottle opening. Since the bottle cannot be sealed again by the dispensing cap, it cannot be inverted in the dispenser, thus discouraging consumer refilling.

Another way that could prevent the refilling of refill bottles, and one that has not been explored to date, is to configure a closure to destruct in such a way that the bottle remains sealed yet the refill bottle no longer fits into the complementary dispenser.

Accordingly, it is desirable to invent new ways to configure tamper-proof closures for refill bottles such that any tampering by the end user destroys the complementary engagement of the closure with the dispenser, but does not expose the end user to the remaining liquid in the refill bottle. That is, it is desirable to design a closure that self-destructs in such a way that the seal on the neck of the bottle remains undisturbed, yet the refill bottle can no longer be used in the complementary dispenser. This would be an important innovation for dispensing systems that dispense highly caustic and/or corrosive liquids from refill bottles, where human contact with the liquid would present a safety hazard. Other desirable features and characteristics of the present invention will become apparent from the subsequent detailed description of the invention and the appended claims, taken in conjunction with the accompanying drawings and this background of the invention.

BRIEF SUMMARY OF THE INVENTION

A closure for a bottle opening is provided that comprises a breakaway portion. The breakaway portion is designed such that it that breaks away from the centrally disposed neck sealing portions of the closure when a consumer attempts to pry the closure from a bottle. More specifically, a closure is provided wherein a circumferential skirt is separable across a frangible demarcation, and wherein breakage across the demarcation separates and removes the functionality required for a keyed fit into a complementary dispenser.

In an embodiment of the present invention, the breakaway skirt of the bottle closure comprises a keyed fit to a complementary dispenser only by virtue of the shape of the skirt. Once the skirt is partly broken off, the refill bottle, still sealed at the container opening, no longer has the shape required for the keyed fit into the complementary dispenser housing.

In another embodiment of the present invention, the breakaway skirt of the bottle closure carries functionality, such as detents, tabs, fins, holes, pins, latches, and the like, that are carried away with the broken and detached skirt portion. Once the skirt is broken into portions, the refill bottle, still sealed at the container opening, no longer has the functionality required for engagement into the complementary dispenser.

In another embodiment of the present invention, the closure comprises a substantially planar top deck portion that allows the bottle to stand stably in an inverted position on a hard surface such as on a shelf in a shower. A frangible demarcation is configured on the closure circumferentially around the central sealing portion of the closure. When an attempt is made to pry the closure from the bottle for the purposes of refilling and reusing the bottle, a portion of the skirt breaks away from the central portion of the closure across the frangible demarcation. The bottle, now having only the part of the closure that seals the neck of the bottle, has insufficient surface area to stand stably in the inverted position resting on the remains of the closure.

In another embodiment of the present invention, the frangible demarcation separating the closure into at least two portions is configured as a plurality of circumferentially disposed perforations. When attempting to pry the closure from the bottle, the skirt will breakaway from the remaining portions of the bottle closure along these circumferentially disposed perforations. The central portion of the closure remains sealed on the neck opening of the bottle preventing exposure to the residual contents therein.

In another embodiment of the present invention, the frangible demarcation between the circumferential skirt and the remaining portions of the bottle closure is configured as a contiguous thinly molded ring. When attempting to pry the closure from the bottle, the skirt will break from the remaining portions of the bottle closure along this weakened circumference. The central portion of the closure remains sealed on the neck opening of the bottle.

In another embodiment of the present invention, the frangible demarcation separating the closure into portions is configured as a line transecting the closure in such a way that a portion of the closure may be broken away across the demarcation causing the loss of some functional element required for complementary fit of the closure into a dispenser housing.

BRIEF DESCRIPTION OF THE DRAWINGS

The present invention will hereinafter be described in conjunction with the following drawing figures, wherein like numerals denote like elements, and.

DETAILED DESCRIPTION OF THE INVENTION

Figure 1:
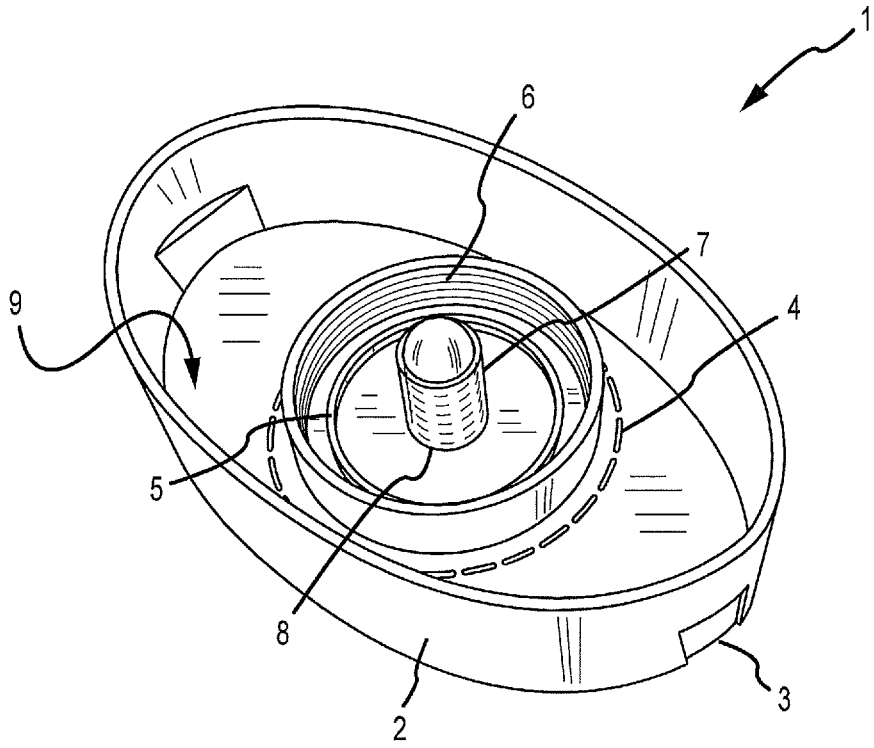
FIG. 1 is a perspective view of the underside of an embodiment of the closure of the present invention, showing functional indents on the breakaway portion of skirt and frangible perforations disposed circumferentially around the center portion of the closure.

The following detailed description of the invention is merely exemplary in nature and is not intended to limit the invention or the application and uses of the invention. Furthermore, there is no intention to be bound by any theory presented in the preceding background of the invention or the following detailed description of the invention.

As will be described in detail below, the present invention is a closure for sealing a necked bottle, wherein said closure minimally comprises a skirt with a frangible line or "breakable demarcation" that divides the closure into at least two portions. In the simplest and most general embodiment of the present invention, the closure comprises an appropriately configured snap sealing ring(s) or threads within or on an inner annular collar that engage and seal the neck of a bottle, and the closure also comprises a circumferential skirt comprising a frangible demarcation. The frangible line separates the skirt into at least two portions, a first portion that includes the sealing portions for the bottle (e.g. an inner annular collar), and a second breakaway portion that comprises at least some functionality required for either engagement of the bottle/closure assembly into a complementary dispenser or that is necessary for standing the bottle/closure assembly in the inverted position on a relatively horizontal hard surface.

The present closure is designed such that any attempt to pry the closure from the bottle, such as by inserting a screwdriver between the inner annular wall of the closure and the neck of the bottle and lifting up, or by grasping the closure with the hand or a tool and attempting to rotate it, will cause the skirt of the closure to break apart in at least two portions. As such, the frangible line that separates the portion of the closure that will remain with the neck of the bottle and the portion of the closure that will be broken away is configured with sufficient weakness such that the frangible line will give way to the forces that may be exerted upon the closure in an attempt to pry it from the bottle.

In the most general of configurations for the present closure, the frangible line or breakable demarcation present on the closure may comprise a plurality of circumferentially disposed perforations, or may simply be a ring (i.e. a circle) of material thinner than the remainder of the skirt that defines a break line. The closure of the present invention is most preferably manufactured from plastic, meaning that perforations may be easily configured into the closure by protrusions provided in the mold, or they may be cut into the plastic closure by post-molding cutting operations (e.g. laser or blades). Alternatively, a circle consisting of a weakened area, may simple consist of a thinner area of plastic which defines a break line across which breakage will occur if forces are applied to the closure. The frangible line, be it comprised of perforations or weakened, thinner plastic, can be in any shape, and follow any path, provided that a section of the skirt breaks away (detaches) from the remainder of the closure. For example, the breakable demarcation may be a relatively straight line and simply traverse the skirt. In that case, a portion of the skirt will still breakaway if forces are applied to the closure, and in the context of the invention, the portion that does breakaway must carry away some functionality that was required for interaction between the bottle/closure assembly and a complementary dispenser, or at least prevent the bottle/closure assembly from standing upside down on the closure. However, the frangible line is preferably approximately circular, either a circle defined by a plurality of circumferentially spaced perforations, or a contiguous circle of weakened area such as a circular thinner region. If circular, the breakable demarcation will surround the portion of the closure that seals on the bottle neck. If not circular, the breakable demarcation will traverse the closure to section it into two portions without traversing into the sealing features of the closure. With these preferred configurations in mind, breakage will preferably leave a substantially disc-shaped portion of the closure skirt on top of the bottle, along with the centrally located elements of the closure including the inner annular wall that remains sealed onto the neck of the bottle. What is broken away in the process of trying to pry the closure from the bottle is a portion of the skirt of the closure, perhaps even most of the skirt, except for a circular portion broken out from the near center of the closure. In other words, the piece of the closure that breaks away and is separated from the bottle may be most of the skirt with only a near disc-shaped hole.

Some definitions and directions orientations are needed to better understand the drawing figures. A bottle for containing liquids typically comprises a bottom, side walls, a shoulder that contiguously merges the side walls into a narrower neck portion, and a top opening in the neck portion. Top and bottom are relative terms, but herein they mean what would commonly be said as to the directions of top and bottom of a bottle when the bottom of the bottle is downward toward the earth, for example resting on a hard surface, and when the open top is necessarily pointing upwards toward the sky. Of course, the bottom to a bottle need not be flat, and that is an option if the bottle is intended to be inverted in use. The actual shape of the bottle is beyond the scope of the present invention, except that whatever bottle is conceived for use with the closure of the present invention, it must comprise a necked in portion that can engage with the present closure, preferably irreversibly. The shape of the bottle, be it round, square, triangular, is immaterial. As to the neck of the bottle for use with the closure of the present invention, the neck will preferably be a narrower extension from the body of the bottle, and will comprise a fastening means for engagement with the closure. The two most common fastening means for fastening a closure to a bottle neck are threads and circumferential beads or lips. A threaded arrangement requires little discussion. The outer wall of the neck of the bottle will carry screw threads, wherein any pitch and depth is envisioned. For a snap-fit arrangement between a closure and a bottle neck, two circumferential beads are provided, one on the outer wall of the neck of the bottle and one inside the closure. The closure snaps on the bottle neck when the closure bead passes over the neck bead. The very top of the open neck of the bottle, that is circumference of the opening, may be tooled in such a way as to promote sealing of the neck of the bottle inside the closure. A resilient lip may be provided around the circumference of the opening for engagement with a complementary circular bead configured up inside the closure. At any rate, when the closure is screwed on or snapped on the bottle, the top of the closure refers to the flat surface of the closure pointing upward to space, and which can also be referred to as the top deck of the closure. The underside of the closure is that portion that engages with the bottle and includes elements that are otherwise hidden from view by a circumferential skirt configured around the closure.

The closure is more easily understood with reference to the drawing figures.

FIG. 1 illustrates an embodiment of the present closure 1 viewed from the underside, and before the closure is sealed onto any bottle. That is, FIG. 1 shows an embodiment of an oval shaped closure of the present invention that may be used to seal the neck of a bottle. When the present closure in FIG. 1 is fitted to the neck of a bottle, the resulting bottle/closure assembly may comprise a true "refill unit" intended to fit inside a complementary dispenser, or the bottle/closure assembly may simple comprise a conventional container, such as packaging for a body wash or shampoo, which is used without a dispenser, but which may be positioned on a shelf or in a box in a way that depends upon the configuration of the closure. In this embodiment in FIG. 1, the closure 1 comprises a substantially flat top deck 9 and a circumferential outer skirt 2 extending down and perpendicularly from the periphery of the top deck 9. The underside of the flat top deck 9 is what's visible in this view from underneath. The top deck portion 9 of the closure 1 is contiguous with the circumferential skirt 2, meaning that they are preferably molded as a single contiguous plastic part. The top deck 9 of the closure defines the overall shape of the closure (such as oval, round, etc.). The circumferential skirt 2 also comprises a functional means 3 that may assist, in part or in whole, in the complementary fit of the closure into a dispenser housing (not illustrated). Such functional means 3 may comprise detents as illustrated in FIG. 1, or may comprise pins, fins, holes, shaped protrusions, bosses, spring loaded latches, and the like, that may interact with complementary features configured in the dispenser, such as in the dispenser housing wherein a refill unit is to be fit. Such functional means 3 are configured on the present closure to discourage the use of any other bottle/closure assemblies that do not include at least these functional means to assist in the fit of the bottle/closure assembly into a complementary dispenser. Most importantly, the closure 1 of the present invention comprises a breakable demarcation 4, i.e. a weakened line, across which the closure can break into at least two physically separated portions. In this particular embodiment illustrated in FIG. 1, the breakable demarcation 4 is comprised of a plurality of circumferentially disposed perforations that end-to-end form a circular breakable line. In this embodiment, the perforations are molded through the thickness of the top deck 9 of the closure 1, such that the perforations appear through to the underside of the closure. However, the breakable demarcation need not be comprised of perforations. Rather, it may be comprised of any feature that is weaker that the remaining portions of the closure. For example, if the closure is made from injection molded plastic, the breakable demarcation 4 may comprise a thinner, weaker zone of plastic that marks a breaking line in the closure. Such thinner molded plastic is sometimes embodied as "living hinges" in the closure art, meaning a line of weakness in the plastic across which parts can hinge, particularly hinged-lids on closures. If made sufficiently thin, this line or ring of thinner plastic material can mark a breaking line or breaking ring in the closure. The weakness configured into the breakable demarcation is qualitatively envisioned to not be so weak as to prevent the installation of the closure on the bottle neck, but to be sufficiently weak enough that any attempt to remove the closure 1 from the neck of the bottle it is sealed on will cause breakage of the closure across the breakable demarcation 4. The weakness of the breakable demarcation 4 can be fine tuned by the thickness of the plastic on that line, and/or by the nature of the perforations (e.g. the number of perforations and/or their dimensions).

It is important to note that the overall shape of the closure of the present invention may be any conceivable and practical shape, (oval, round, square, rectangular, etc.), and the dimensions may be any practical dimensions, (tall, short, wide, narrow, etc). The only limitations, if any, may be that the closure needs to at least be moldable (such as molded through plastic injection molding). In fact, the mere shape of the closure may influence the fit of the closure (and hence the fit of a bottle/closure assembly) into a complementary shaped dispenser. For example, for the oval shaped closure embodiment depicted in FIG. 1, an oval shaped dispenser housing may be configured to receive this particular closure when the closure is fitted onto a filled bottle and that packaging unit is then inverted into the dispenser housing. Therefore, shape may be important in certain embodiments of the present invention as pertaining to functionality or even to aesthetics. Additionally, the top deck portion 9 of the closure 1 may be substantially flat, or it may have some sort of concave curvature to it, either for aesthetics, or market branding, and/or to assist in a complementary functional fit inside a dispenser housing. As mentioned above, a nearly flat or perfectly flat top deck portion 9 of the present closure 1 is typically seen in body wash and shampoo packaging where it is expected that the package will be left upside-down in use. In this way the liquid product is kept at the closure end of the package (what is technically the top of the bottle) for ready dispensing. Certainly this is common practice when using body wash and shampoo in a shower, where the package may be left inverted on the shelf in the shower. In this case, destruction of the shape of the closure, particularly the destruction of the flat top features to the top deck 9 of the closure 1, will prevent the packaging from being stored upside-down. Therefore, mere breakage of a substantially flat top deck of a closure such that insufficient flat surface area remains for standing the product upside-down destroys the convenience of being able to store the package inverted. Another articulation is that the substantial "flatness" of the top deck portion 9 of the closure 1 may be the functionality that is removed from the package when the closure is broken, much like the functional element 3 being carried away from the bottle when the closure is broken apart.

Still referring to FIG. 1, the present closure necessarily includes a means for sealing the closure onto the neck of a bottle. Typically, and preferably here, the closure includes an inner annular collar 6 that appears as a raised wall or inner skirt inside the overall structure of the closure. Such an inner annular wall is preferably located somewhat centrally in the closure, extends perpendicularly from the bottom side of the top deck portion, and is preferably circular in shape. Necessarily the inner annular collar is essentially concentric with the outer skirt, although the shapes need not be identical. For example, the inner annular collar may be substantially circular yet the outer circumferential skirt may be oval, even though the special relationship of the two may still be referred to as "concentric." Since both the outer skirt and the inner annular collar emanate perpendicularly from the top deck of the closure and are concentric, their walls must be substantially parallel at any given point. Bottle necks are usually circular for practical reasons and hence the sealing portions of closures are typically circular as well. Here, the preferred inner annular collar 6 is circular and it may be dimensioned to be from about 1 mm to about 5 cm in height (i.e., the extension from the underside of the top deck 9 of the closure to the annular end wall of the collar). The height is chosen to complement the neck of the bottle onto which the closure will be sealed. Practically, the sealing portion of the neck of a bottle made for liquid may be from about 5 mm to about 2 cm, and hence the height of the inner annular collar 6 in the present closure may take on that same approximate height. At least for aesthetic reasons, the height of the inner annular collar 6 will be equal to or less than the height of the outer circumferential skirt such that the outer skirt "hides" the collar and the entire top shoulder of the bottle. The diameter of the inner annular collar 6 approximates the diameter of the neck of the bottle onto which it seals, and is preferably about 5 mm to about 5 cm in diameter. Importantly, if the breakable demarcation 4 is circular, then the diameter of the breakable demarcation 4 is necessarily larger than the diameter of the inner annular collar 6. This is important because when the closure 1 breaks across the breakable demarcation 4, the bottle must remain sealed. Therefore, the breakable demarcation 4 cannot intersect with the inner annular collar 6 regardless if the breakable demarcation 4 is circular (as in FIG. 1) or if it defines a somewhat linear path that bisects the closure into at least two portions (as will be described in the context of FIG. 8). As mentioned above, the inside of the inner annular collar 6 comprises sealing means for securing the closure on a bottle neck. The sealing means may comprise internal screw threads complementary to the threads provided on the exterior of the neck of the bottle. Such screw threads configured on a neck of a bottle and on the inside of a collar for a closure may be configured with any pitch and depth. Alternatively, the inside wall of the inner annular collar may be configured with at least one circumferential bead or shoulder that is dimensioned to snap over a complementary bead on the neck of the bottle or snap into a circumferential slot in the bottle neck. More specifically, a circumferential bead may protrude radially inwards on the inside wall of the inner annular collar.

For additional sealing to the uppermost circumferential lip of an opening of a bottle (sometimes referred to as the annular end wall of the bottle neck), the closure 1 may also include a sealing means 5 configured onto the underside of the top deck 9 within the area bounded by the circumference of the inner annular collar 6. Such additional sealing means 5 may be provided regardless if the inner annular collar 6 includes internal threads to engage complementary bottle threads, or sealing rings to engage features on the outer surfaces of the bottle neck. Such a sealing means 5 may comprise a ring of "spongier" material, such as an area of resilient plastic, or an inlaid rubber or other elastomeric washer that will seat onto the relatively sharp annular end wall of the bottle neck. Such a sealing ring, washer or bead, may be dimensioned to align with the bottle opening on the neck of the bottle. Alternatively, and discussed below, the sealing feature 5 provided on the underside of the top deck 9 of the closure may comprise a plurality of circumferentially disposed ratchet teeth configured to engage in complementary teeth provided around the circumference of the annular end wall of the container neck.

Still referring to FIG. 1, the closure 1 of the present invention, especially if the closure 1 is to be used as part of a refill bottle assembly, may include a dispensing orifice 8. The orifice 8 may simply be a small hole through the closure, preferably located centrally on the closure. Minimally, the orifice 8 must reside within the area defined by the perimeter of the inner annular collar 6 such that the orifice 8 provides a liquid passageway for the contents of the bottle from the interior of the bottle to the outside the bottle. As mentioned, the orifice 8 provides an exit for the liquid contained in the bottle without the need to break the seal formed between the inner annular collar 6 and the neck of the bottle (and the sealing feature 5 onto the annular end of the neck of the bottle) onto which the closure is eventually fastened to. Since the bottle needs to be merchandized (stored, boxed, shipped, etc.), this orifice 8 will preferably be sealed in some way rather than left as an open hole. Additionally, and in the context of a dispensing system, the package comprising the closure 1 and a bottle containing liquid will need to be inverted into a dispenser, and an open hole 8 will be a dripping problem when the package is being inverted into the dispenser. Therefore, the orifice 8 will preferably be sealed by a structure that can be opened either manually by the end user or automatically by a feature configured in the dispenser, For example, the orifice 8 may be sealed by a spring and ball valve 7 as depicted in FIG. 1, or with a resilient valve such as a slit valve, or by a breakable membrane (foil, cellophane, or laminated material), or by some other resilient member than can be deformed to an open state from a shipping/sealed state. As a non-limiting example, a spigot present in the dispenser and protruding upwards within the dispenser housing, may be suitably situated to penetrate the orifice 8 when the package comprising the closure 1 and a liquid filled bottle is inverted into its complementary dispenser. Such a spigot may push up and compress a spring and move a ball out of its seat to unseal the orifice. Alternatively the spigot may protrude up through a resilient valve, or it may irreversibly puncture through a foil or plastic film seal that was covering the orifice. Thus the ball and spring sealing valve 7 depicted in this particular embodiment may be replaced by any sealing means conceivable for either irreversible or reversible sealing of a small hole in a closure. Useful dispensing valves that are opened by complementary fitting orifices configured in a dispenser housing are described in detail in PCT Application Publication Nos.: WO 2010/055314 and WO 2010/055309 (Xianzhi et al.), both of which are incorporated herein in their entireties by reference. If dripping is not a concern when inverting the bottle/closure assembly into a complementary dispenser, the orifice 8 may be sealed from the topside of the closure with a small hinged-lid snap closure. That is, the orifice 8 may be closed off reversibly by a closure within a closure. A hinged-lid snap closure that is configured to seal the orifice 8 provides a way for the refill unit to be merchandized without leakage of liquid through the orifice 8.

Figure 2:
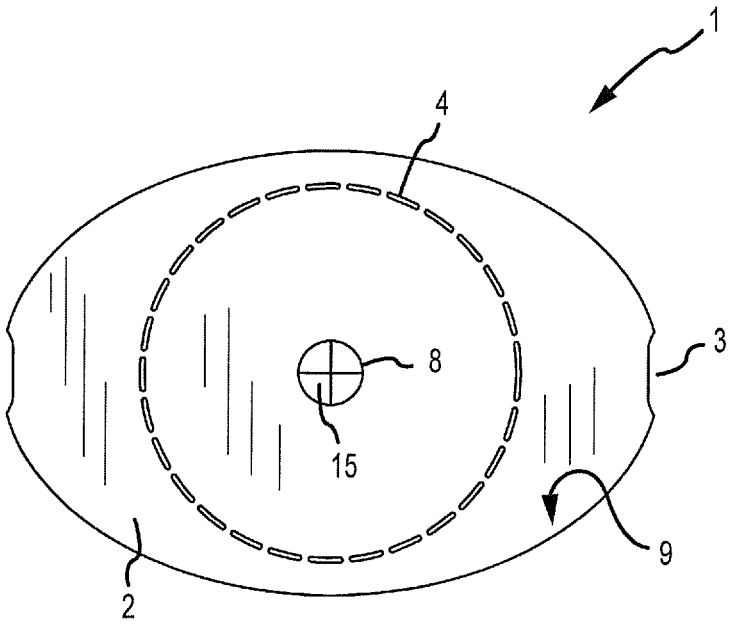
FIG. 2 depicts a top view of an embodiment of the closure of the present invention, showing the top deck of the breakaway skirt and frangible perforations disposed circumferentially around the center portion of the closure.

Referring now to FIG. 2, the top view of an embodiment of the closure 1 of the present invention is depicted. The embodiment of FIG. 2 is also an oval shaped closure as per FIG. 1, although the closure need not be oval shaped. In the top view of the closure 1, one or more detents or slots 3 may provide engagement with complementary protrusions provided in the housing of the dispenser into which the closure 1 (fitted on a bottle) will fit. That is, at least one detent, slot, latch, or the like (represented by 3) may be a functional means for securing the refill unit into a complementary dispenser. A dispensing orifice 8 is shown centrally located in the oval shaped closure 1 through the top deck 9, and the orifice 8 in this embodiment is shown sealed with a resilient valve member 15. Such resilient valves are well known in the art, and may be comprised of butyl or silicone rubber, or other silicone polymer. Such elastomeric valves may be provided with slits, such as crosshair slits, that open as leaves when a pipe or other orifice is pushed through. Alternatively, an elastomeric member sealing orifice 8 may be without any slits, and a spear-like, sharpened or otherwise pointed spigot in the dispenser is configured and aligned to puncture up through the septum. Upon removal of the spigot, the elastomeric member will seal itself.

Still referring to FIG. 2, the closure 1 of the present invention necessarily comprises a breakable demarcation 4 configured as a weakened line across which the closure will break if forces are applied to the closure after the closure is sealed onto a bottle. In the embodiment depicted, the breakable demarcation 4 is circular, and that circle has a diameter that is larger than the diameter of the inner annular collar (not visible in this top view of the closure). For the embodiment depicted in FIG. 1, breakage across the breakable demarcation 4 will necessarily leave the bottle sealed with the remains of the closure that comprise the inner annular collar. The portion of the closure 1 that would be broken away when the weakened demarcation gives way is essentially the skirt 2 of the closure 1, albeit with a broken out disc missing from the center.

Figure 3:
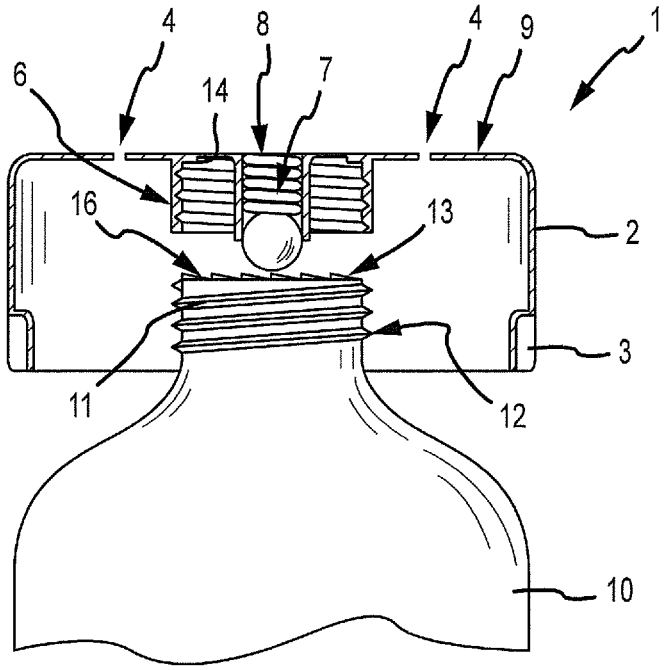
FIG. 3 illustrates a cross-sectional view of an embodiment of the closure of the present invention in sealing position lined up over the opening of a bottle.

FIG. 3 depicts the cross sectional view of an embodiment of the closure 1 of the present invention, with the closure 1 lined up in the proper orientation for registration and sealing onto a bottle 10. As mentioned, the shape of the bottle 10 is beyond the scope of the present invention, although the bottle preferably has a necked in region 11 that culminates in a neck opening 16 that may be sealed with the appropriately configured closure 1. A bottle neck useful with the closure of the present invention may include screw threads 12 as shown, or some other sealing means such as circumferential beads. In the case of a bead or lip, a bead extending radially outwards may be configured around the circumference of the neck of the bottle and a complementary circumferential recess may be configured within the inner annular collar (or vice-versa). In this cross-sectional view, the closure 1 is seen to comprise at least one functional element 3 used for engagement with complementary features in a dispenser housing. The closure 1 is also seen to comprise an inner annular collar 6. The inner annular collar descends from the top deck 9 of the closure by the distance suitable for sealing on the neck of the bottle, such as from about 1 mm to about 5 cm in height. In this way, the inner annular collar is essentially an inner skirt concentric with the outer circumferential skirt 2 of the closure. The diameter of the inner annular collar 6 is from about 5 mm to about 5 cm and is appropriately dimensioned in accordance with the diameter of the neck opening 16 of the bottle 10. The closure 1 is also seen to comprise an orifice 8 for dispensation of liquid from the bottle 10 when the completed packaging is inverted. The orifice 8 may be reversibly sealed with a ball and spring valve 7 as depicted in FIG. 3 or any other sealing element such as an elastomeric valve. The closure 1 also comprises breakable demarcation 4 across which the closure can break if forces are applied to the closure to remove it back off the bottle 10.

Still referring to the cross-sectional view in FIG. 3, the closure 1 is seen to comprise functional means 14 for irreversible engagement with the annular end wall 13 of the bottle opening 16. In this particular embodiment, the bottle opening 16 comprises ratchet teeth 13 for irreversible engagement with the closure. For proper registration and irreversible fastening of the closure 1 onto the bottle 10, a plurality of circumferentially disposed ratchet teeth 14 may be provided on the underside of the top deck 9 of the closure, and within the confines of the inner annular collar 6 such that the ratchet teeth 14 in the closure irreversibly register in the plurality of ratchet teeth 13 circumferentially disposed around the annular end wall of the bottle neck opening 16. This configuration is amply described in U.S. Pat. No. 4,747,498 (Gach) incorporated herein by reference.

Still referred to FIG. 3, once the closure 1 is secured onto the bottle 10, the only means for removal of the closure from the bottle is to pry it off by lifting and avoiding the irreversibility of the interlocked sets of ratchet teeth, or to reverse the closure against the ratchet teeth. However, the closure 1 is configured such that the breakable demarcation 4 will give way before the sets of ratchet teeth (13/14) can be overridden, breaking the closure into at least two portions.

Figure 4:
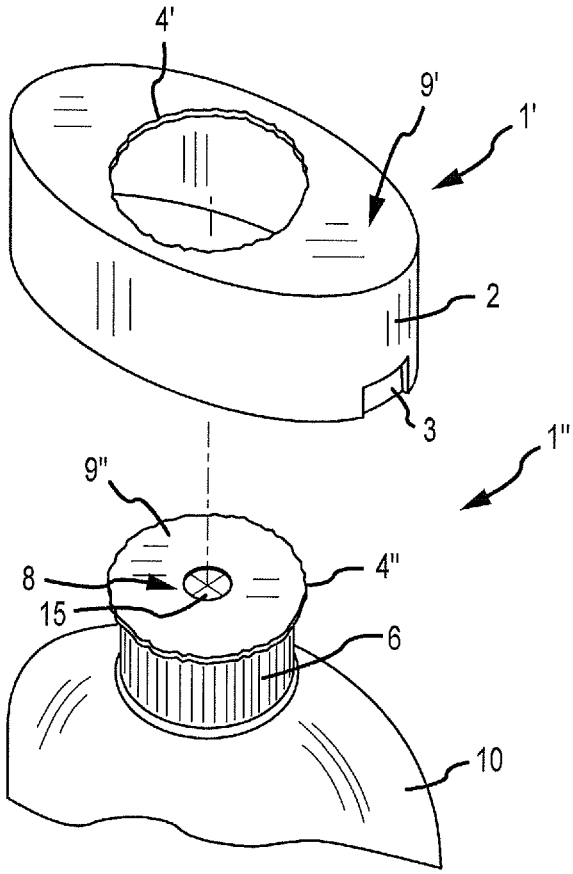
FIG. 4 illustrates an embodiment of the closure of the present invention in use on a bottle where an attempt was made to pry the closure from the bottle causing the skirt to break along the perforations leaving the bottle still sealed by the remaining portions of the closure and the loss of the functional elements of the skirt to the broken away portions.

FIG. 4 depicts the parts of the closure 1 remaining after a user attempts to pry the closure 1 from the bottle 10 after the closure 1 has been snuggly sealed onto the bottle 10. FIG. 4 illustrates the most important and innovative feature to the present invention. The novelty and non-obviousness of the present closure 1 is in its design to break apart in such a way that the seal between the closure 1 and the bottle 10 remains undisturbed even though the closure is broken into at least two portions. This is very important if the liquid provided in the bottle 10 as part of a filled refill unit is corrosive. If a user attempts to open the package to access the interior of the bottle 10 for any reason, such as to refill it with their own liquid, the closure 1 will break across the breakable demarcation 4 resulting in two portions indicated as 1' and 1". One portion of the closure, indicated as 1", remains sealed on the bottle, and this portion 1" comprises the inner annular collar 6 still irreversibly engaged to the bottle 10. The portion of the closure 1" still sealing the bottle includes the dispensing orifice 8 and the disc-shaped remains of the top deck of the closure, indicated as remains 9". The portion of the closure 1" still sealing the bottle necessarily comprises the elastomeric valve 15 (or other orifice sealing element), and the screw threads and/or beads configured on the neck of the bottle and inner annular collar of the closure, and/or the sets of ratchet teeth or sealing neck lip and bead (all within the remains of the closure and not visible in this perspective view). The bottle 10 remains sealed because all of the functional elements of the original closure that were used to seal the closure to the bottle are undisturbed by the breakage of the closure across the frangible demarcation. This is so because the frangible demarcation does not intersect with the inner annular collar (and hence with any sealing features) of the closure. The circumference of the remaining top deck 9" is outlined by one side of the broken demarcation 4, here denoted as circumference 4". If the frangible demarcation 4 was configured as perforations, the circumference 4" of the remaining top deck portion 9" may be rough, for example having a sawtooth or other jagged structure.

Still referring to FIG. 4, the portion 1' of the closure 1 that has been broken away from the bottle 10 comprises the majority of the circumferential skirt 2 of the original closure except for an approximately disc-shaped hole broken out from the center. The hole has circumference 4', which is essentially the circumference of the original breakable demarcation 4. Again, if the demarcation was configured as a perforated circle, the circumferential edge 4' may be left as a jagged edge. The skirt 2 is seen to comprise at least one functional element 3 that was usable to engage with a complementary functional element in a dispenser. Therefore, since the bottle 10 no longer has a skirt having this functional element 3, the bottle sealed with only the remaining closure portion as shown can no longer fit inside a complementary dispenser designed to engage with functional element 3. The portion 1' is irreversible broken away from the bottle when an attempt is made to open the bottle to refill it. The safety of the user is maintained because he/she cannot succeed in accessing the interior of the bottle 11 by prying off the closure. In the preferred embodiment, the remains of the closure (collar 6, top deck portion 9") are held snugly and irreversibly onto the bottle 10 by means of interlocking sets of ratchet teeth. Therefore, now that the skirt 2 has been broken off from the bottle, the user still cannot gain access to the bottle and any remaining liquid therein.

As mentioned above, it is important to remember that the breakable demarcation 4 need not be circular as in the embodiment in FIG. 4. It may instead be a somewhat linear frangible demarcation that bisects or otherwise traverses across the closure so long as a portion 1' of the closure breaks away and carries with it at least one functional element 3 necessary for engagement in a dispenser, or such that after breakage, the remaining closure portion 1" does not provide sufficient flat surface area (i.e. remains 9") for standing the bottle 10/closure 1" package in an inverted position.

Figure 5:
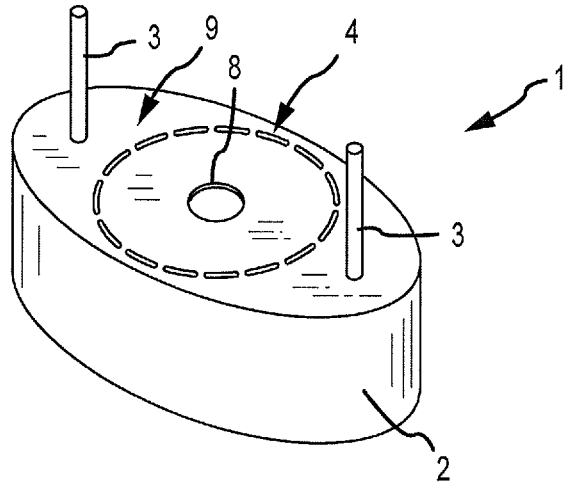
FIG. 5 illustrates an embodiment of the closure of the present invention comprising functional pins configured to engage with complementary features of a dispenser.

FIG. 5 is a top perspective view of another embodiment of the closure of the present invention wherein the functional means 3 for engaging with complementary features in a dispenser housing is in the form of pins. Other protrusions or "bosses" may be envisioned for the closure of the present invention, provided that at least one of these protrusions is broken away with a portion of the closure and such that the remains of the closure on the bottle no longer fits into a complementary dispenser because of the loss of the functional element 3. In this embodiment pictured, the breakable demarcation is circular, and it is comprised of circumferentially disposed perforations. The closure of FIG. 5 is expected to break apart in a similar fashion as the closure of FIG. 4, (that is, it is expected to break into portions 1' and 1").

Figure 6:
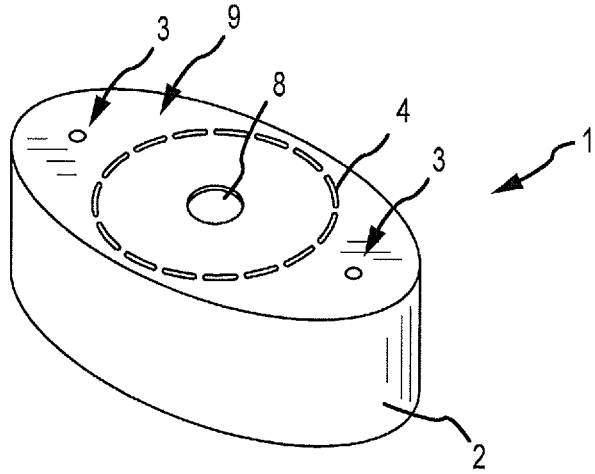
FIG. 6 illustrates an embodiment of the closure of the present invention comprising functional holes configured to engage with complementary features of a dispenser.

FIG. 6 is a top perspective view of another embodiment of the closure of the present invention wherein the functional means 3 for engaging with complementary features in a dispenser housing is in the form of small holes. Other shaped holes or indentations may be envisioned for the closure of the present invention, provided that at least one of these functional elements is broken away with a portion of the closure and such that the remains of the closure on the bottle no longer fits into a complementary dispenser because of the loss of the functional element 3. Holes 3, such as depicted in FIG. 6, may be configured to accept complementary pins or posts or other protrusions generally pointing upwards inside a dispenser housing. In this particular embodiment pictured, the breakable demarcation is circular, and it is comprised of circumferentially disposed perforations. The closure of FIG. 6 is thus expected to break apart in a similar fashion as the closures of FIGS. 4 and 5, (that is, it is expected to break into portions 1' and 1").

Figure 7:
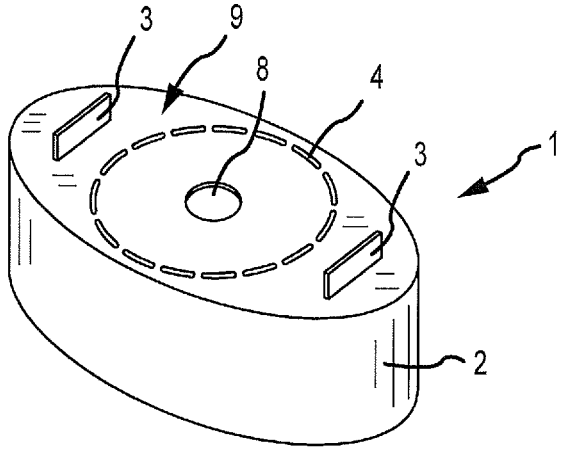
FIG. 7 illustrates an embodiment of the closure of the present invention comprising functional fins configured to engage with complementary features of a dispenser.

FIG. 7 is a top perspective view of another embodiment of the closure of the present invention wherein the functional means 3 for engaging with complementary features in a dispenser housing is in the form of fins. Other protrusions may be envisioned for the closure of the present invention, provided that at least one of these protrusions is broken away with a portion of the closure and such that the remains of the closure on the bottle no longer fit into a complementary dispenser because of the loss of the functional element 3. In this embodiment pictured, the breakable demarcation is circular, and it is comprised of a ring of weakened plastic, such as may be achieved by molding thinner plastic material in this ring. The closure of FIG. 7 is expected to break apart in a similar fashion as the closures of FIGS. 4, 5 and 6, (that is, it is expected to break into portions 1' and 1"), although the breakage is expected to leave closure portions with smooth rather than jagged break lines.

Figure 8:
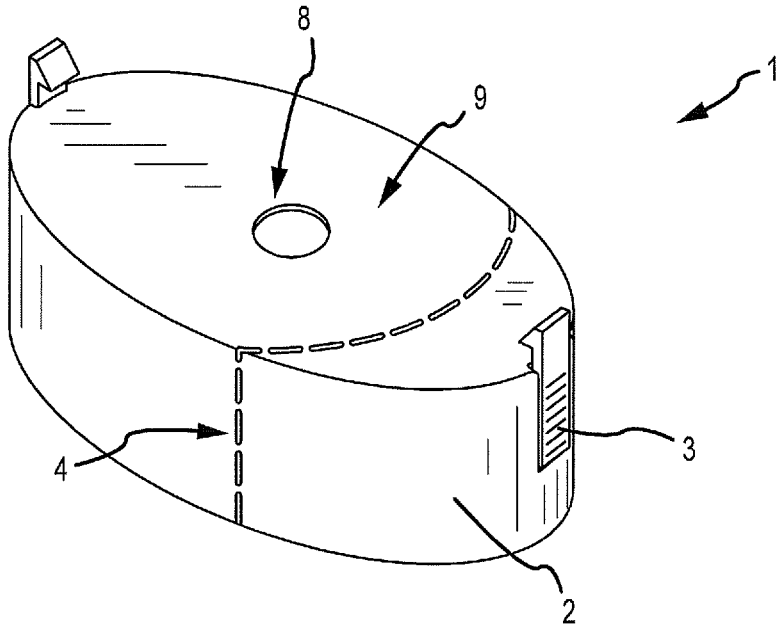
FIG. 8 illustrates in perspective view an embodiment of the closure of the present invention comprising latches to engage within a dispenser and a perforated frangible demarcation across which the closure may break into two pieces when attempting to pry the closure from a bottle.

FIG. 8 is a top perspective view of another embodiment of the closure of the present invention wherein the functional means 3 for engaging with complementary features in a dispenser housing is in the form of at least one latch. Such latches may be of any practical shape, and may be spring loaded, resilient, or simply movable within a track. Other latch configurations may be envisioned for the closure of the present invention, provided that at least one of the latches is broken away with a portion of the closure and such that the bottle sealed with only the remains of the closure no longer fits into a complementary dispenser because of the loss of the functional latch element 3. In this embodiment pictured, the breakable demarcation traverses across the closure, bisecting the closure into two portions of relatively similar size. Breakage across this frangible demarcation will break off at least one functional latch element 3, leaving behind only a portion of the closure on the bottle unable to snap inside the complementary dispenser.

Closures in general throughout the packaging industry are typically made of plastic and prepared by injection molding and/or injection blow-molding processes. The preferred materials of construction herein are polyethylene (for example, LDPE or HDPE), although any moldable plastic is viable and other materials may be preferred based on the corrosive or aggressive nature of the liquid toward plastic. Some fluorinated polymers are known to rip easily and cleanly and may be more useful than polyethylene in some configurations of the present invention wherein the breakage of the closure when attempting to remove it from a bottle is more a tearing process than a cracking process.

While at least one exemplary embodiment has been presented in the foregoing detailed description of the invention, it should be appreciated that a vast number of variations to the present invention exist. It should also be appreciated that the exemplary embodiment or embodiments are only examples, and thus not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

I claim:

1. A closure for an open neck bottle used as a refill in a dispenser, said closure comprising:

a) a top deck having a periphery and a surface contour together defining an overall shape to the closure, the top deck comprising at least one functional element configured for engagement with a complementary means inside a dispenser;

b) an orifice passing through a relatively central location on said top deck;

c) an outer circumferential skirt extending substantially perpendicular from the periphery of said top deck portion;

d) an inner annular collar extending underneath and perpendicular to said top deck, said collar relatively concentric to said outer circumferential skirt, said inner annular collar surrounding said dispensing orifice and configured with internal sealing means for sealing engagement with complementary features on a neck of a bottle; and e) a frangible demarcation configured on said closure, separating said closure into at least first and second portions without intersecting said inner annular collar, the first portion including the internal sealing means and the dispensing orifice, and the second portion including at least part of the top deck, whereby breaking the closure along the frangible demarcation separates the first and second portions.

2. The closure of claim 1, wherein said frangible demarcation is circular in shape and is configured on the top deck of the closure concentric to the inner annular collar, and wherein said circular demarcation has a diameter greater than the diameter of said inner annular collar.

3. The closure of claim 1, wherein said frangible demarcation is comprised of a plurality of perforations.

4. The closure of claim 2, wherein said frangible demarcation is comprised of a plurality of circumferentially disposed perforations.

5. The closure of claim 1, wherein said frangible demarcation is comprised of plastic material that is thinner than the thickness of said skirt of said closure.

6. The closure of claim 1, wherein said frangible demarcation traverses said closure, bisecting said closure across any axis into the first and second.

7. The closure of claim 1, further comprising a valve reversibly sealing said orifice.

8. The closure of claim 1, further comprising a plurality of circumferentially disposed ratchet teeth projecting underneath said top deck, said circumferential disposition having a diameter less than the diameter of said inner annular collar and configured for locking engagement with a complementary set of circumferentially disposed ratchet teeth around said open neck of said bottle.

9. A refill unit for use in dispensing system comprising:

a) closure of claim 1; and b) a bottle containing a liquid and having a neck culminating into an open annular end wall, wherein said bottle is sealed on said neck with said closure; and wherein force, being applied to the closure to remove the closure from the bottle neck, will break the closure across said frangible demarcation into at least the first and second portions without compromise of said seal on said bottle neck.

10. The closure of claim 1, wherein said surface contour of said top deck is substantially planar and wherein said functional element comprises only the substantially planar top deck of the closure.

11. The closure of claim 10, further comprising a hinged-lid closure configured for reversible sealing engagement of said dispensing orifice.

12. The use of the closure of claim 1 in a refill unit comprising the assembly of said closure and a bottle of liquid, said refill unit configured to fit in a dispenser as part of a dispensing system.

* * * * *